US005597115A

United States Patent [19]

Reo

[11] Patent Number: 5,597,115

[45] Date of Patent: Jan. 28, 1997

[54] RESEALABLE CONTAINER FOR POWDERED MATERIALS

[75] Inventor: Joseph Reo, Princeton Jct., N.J.

[73] Assignee: Church & Dwight Co., Inc., Princeton, N.J.

[21] Appl. No.: 644,305

[22] Filed: May 10, 1996

[51] Int. Cl.[6] ..... B65D 5/54

[52] U.S. Cl. ..... 229/229; 229/125.42; 229/234

[58] Field of Search ..... 229/217, 229, 229/232, 233, 234, 125.42

[56] References Cited

U.S. PATENT DOCUMENTS

| | | | |
|---|---|---|---|
| Re. 31,425 | 10/1983 | Steinke et al. . | |
| 742,271 | 10/1903 | Allen . | |
| 939,825 | 11/1909 | Frank . | |
| 1,303,138 | 5/1919 | Woolwine . | |
| 1,709,840 | 4/1929 | Compton . | |
| 1,746,006 | 2/1930 | Metzger | 229/234 |
| 2,326,527 | 8/1943 | Emmerich | 229/229 |
| 2,360,415 | 10/1944 | Gilbert | 229/229 |
| 2,470,388 | 5/1949 | Ball . | |
| 2,593,019 | 4/1952 | Glaser . | |
| 2,946,496 | 7/1960 | Stagmeier | 229/234 |
| 3,395,848 | 8/1968 | Johnson | 229/234 |
| 3,426,955 | 2/1969 | Olson | 229/229 |
| 3,971,506 | 7/1976 | Roenna | 229/234 |
| 4,015,768 | 4/1977 | McLennan | 229/234 |
| 4,126,263 | 11/1978 | Martinsson | 229/229 |
| 4,799,594 | 1/1989 | Blackman | 229/229 |
| 5,452,850 | 9/1995 | Allsop | 229/229 |

*Primary Examiner*—Gary E. Elkins
*Attorney, Agent, or Firm*—Irving M. Fishman

[57] ABSTRACT

A three-dimensional resealable container for dispensing powdered or particulate material comprising a top portion, a bottom portion and at least one side portion, the top portion being comprised of an inner section with a die-cut piece, an intermediate section contiguous to said inner section and provided with a hinged flap portion adapted to open and close the container with the die-cut piece secured to the hinged flap, and an outermost section with a pattern of perforations such that a removable segment of such section which covers the hinged flap can be manually removed.

6 Claims, 2 Drawing Sheets

RESEALABLE CONTAINER FOR POWDERED MATERIALS

BACKGROUND OF THE INVENTION

1. Field of the Invention

This invention relates to an improved resealable container for powdered materials.

2. Background Information Including Description of Related Art

Box-like containers or cartons for powder or other pulverized materials are well known. For example, U.S. Pat. No. 1,709,840 relates to powder boxes formed from pasteboard and the like. Box-like containers or cartons having perforations or other openings to dispense the contents therein are also known, e.g., U.S. Pat. Nos. 742,271 and 939,825 which disclose folded blank paper boxes capable of being used as shakers to dispense pepper or other spices or pulverized material. In U.S. Pat. No. 1,303,138 a similar box is described having a liftable flap for opening and reclosing the container. U.S. Pat. Nos. 2,470,388 and 2,593,019 disclose containers for liquids which employ a hinged lid or "door" for opening and closing the container.

A particularly advantageous resealable container for powdered materials is disclosed in U.S. Reissue Pat. No. Re 31,425, such container being provided with a top portion comprising an outer section having a hinged flap adapted to open and close the container and an inner section having a die-cut portion to which the hinged flap may be secured. However, this design has the disadvantage that since the hinged flap is exposed when the container is on the store shelf, the customer may have a tendency to lift the flap and sample the product, since this can be done without altering the appearance of the container after the flap is returned to its closed position, thus reducing the product to below the quantity stated on the label.

SUMMARY OF THE INVENTIONS

In accordance with this invention, a resealable container for a powdered material is provided which eliminates or minimizes the disadvantages of the containers disclosed in the foregoing prior art references, such inventive container being resealable and having, before it is initially opened, a top portion, a bottom portion and at least one side portion, the top portion being comprised of an inner section with a die-cut piece, an intermediate section contiguous to said inner section and provided with a hinged flap portion adapted to open and close the container with the die-cut piece secured to the hinged flap., and an outermost section with a pattern of perforations such that a segment of such section which covers the hinged flap can be manually removed by pulling it off the top of the container. The hinged flap, which is thus exposed, can then be lifted to gain access to one or more openings in the inner section of the top portion of the container from which the powdered material may be obtained.

The foregoing design thus has the effect of discouraging sampling of the powdered material in the container since to gain access to such material, a segment of the outer section of the container must be conspicuously pulled off to expose the hinged flap used to reseal the container.

DESCRIPTION OF THE PREFERRED EMBODIMENTS

Figure 2:
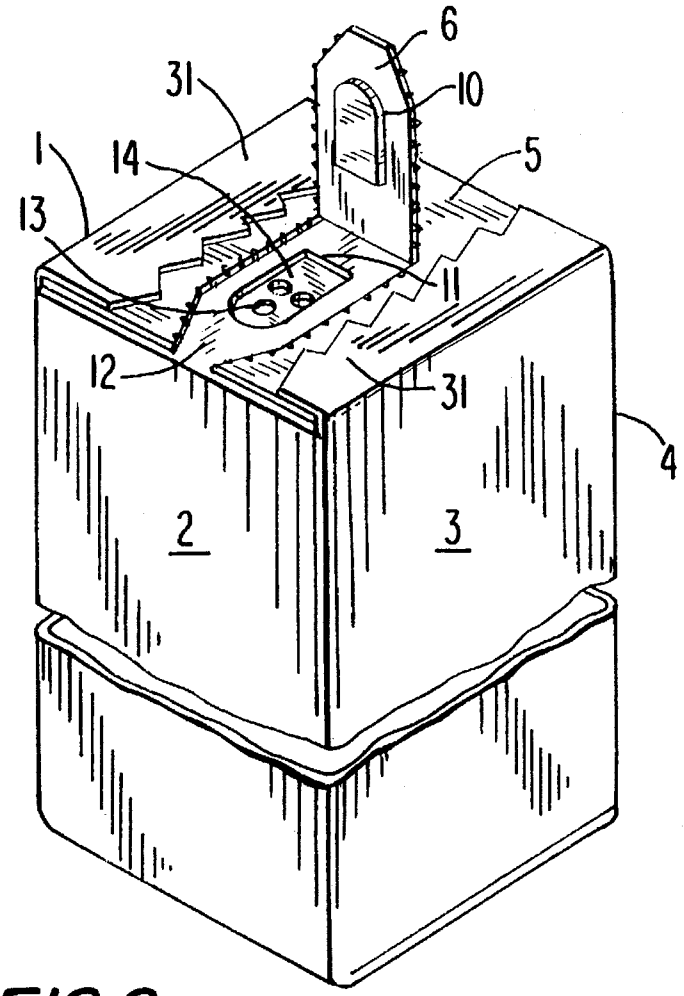
FIG. 2 is a perspective view similar to FIG. 1 after the segment of the outer section of the top portion between the lines of perforations has been removed and the hinged flap in the intermediate section of the top portion immediately below the removed segment has been raised.

As stated, the resealed container of this invention before it is initially opened has a top portion, a bottom portion and at least one side portion, the top portion being comprised of an inner section with a die-cut piece, an intermediate section contiguous to said inner section and provided with a hinged flap portion adapted to open and close the container with the die-cut piece secured to the hinged flap., and an outermost section with a pattern of perforations such that a segment of such section which covers the hinged flap can be manually removed by pulling it off the top of the container. After the hinged flap is lifted to provide an opening through which the powdered material can be poured, the container can be resealed by pressing the hinged flap down to establish frictional contact between the die-cut piece affixed to the underside of the hinged flap which forms part of the intermediate section of the top portion of the container and the corresponding die-cut opening in the inner section of the top portion of the container, resulting in a firm fixation of the hinged flap in a sealed position. In a preferred embodiment, the free end of the hinged flap extends to the edge of the top portion and a segment of each side of the hinged flap extending from its free end is tapered for easy gripping in opening and resealing the container. The die-cut piece affixed to the hinged flap and the corresponding die-cut opening in the inner section of the top portion of the container may have any convenient configuration.

The container may be made of any suitable material, including cardboard, pasteboard, kraft, newsback board, solid bleached sulfate, and the like. It is within the scope of the invention that certain polymeric materials capable of being scored, folded, and die-cut, may be used, such as for example, polyethylene. The useful materials may be wax-coated, on one or both sides of the blank.

The container of this invention is useful for storing and dispensing virtually any powder or other material pulverizable to a size small enough to pass through the openings or perforations in the top. Typical of such dispensable materials are pepper, salt, sugar, other spices, talc, sodium bicarbonate, cleansers, deodorizers, e.g., carpet deodorizers, and the like.

The resealable container of this invention may have any horizontal cross-section, including triangular, square, rectangular, pentagonal, octagonal, circular, etc. Rectangular and square shapes are preferred and square shapes are especially preferred.

A preferred three-dimensional container of the invention is comprised of a single blank of material cut and scored to form four sides, the bottom, and the top of the carton when folded to position, the top of the carton comprising four sections which are linear extensions of the side portions including an innermost section formed with registered openings or perforations, a second from the innermost section having a die-cut piece centrally registered with the openings or perforations of the innermost section, an intermediate or second from the outermost section having a hinged flap adapted to cover and close said openings or perforations, the die-cut piece being affixed to the hinged flap, and an outermost section with a pattern of perforations such that a segment of such section covering the hinged flap can be easily pulled off the top of the container.

Figure 1:
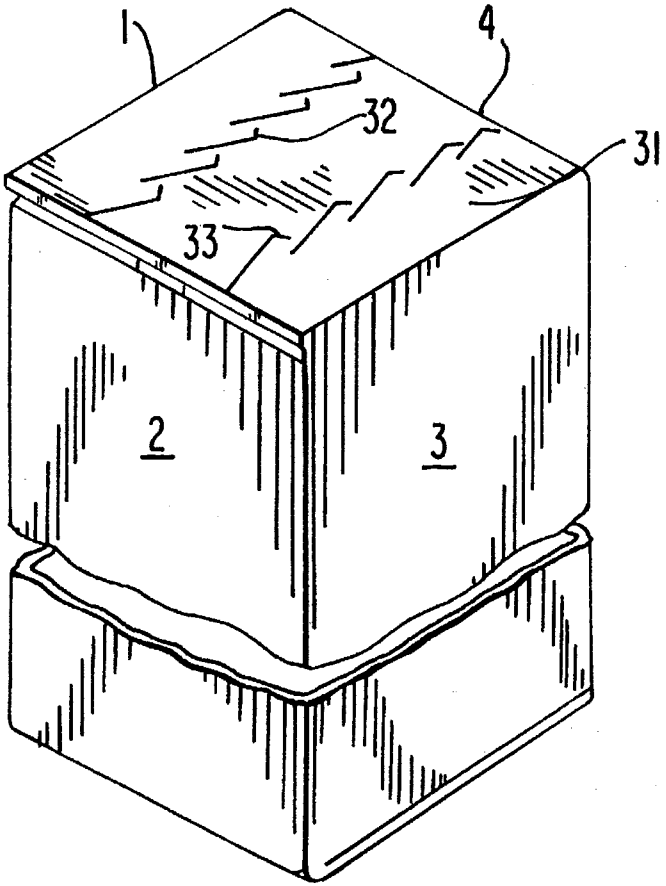
FIG. 1 is a perspective view of one embodiment of the invention showing the container prior to being initially opened, with the outer section of the top portion containing two lines of perforations such that the section between the perforations may be easily removed by the purchaser to expose a hinged flap.

Referring now to the drawings, the embodiment of the invention shown in FIG. 1 has side walls 2 and 3 shown, as well as side walls 1 and 4 not shown. Top section 31 contains die-cut, perforated lines 32 and 33 parallel to two opposite sides and extending to the two right angle sides of the container, the segment between such lines being manually removable from the top of the container to expose a hinged flap.

FIG. 2 shows the embodiment of FIG. 1 wherein the segment of the top section 31 between perforated lines 32 and 33 has been removed and hinged flap 6 is in a raised position. Die-cut piece 10, which is affixed or glued to the underside of the hinged flap 6, is cut from, and fits snugly into, opening 11 in section 12. Visible through opening 11 are perforations or openings 13 in section 14.

Figure 3:
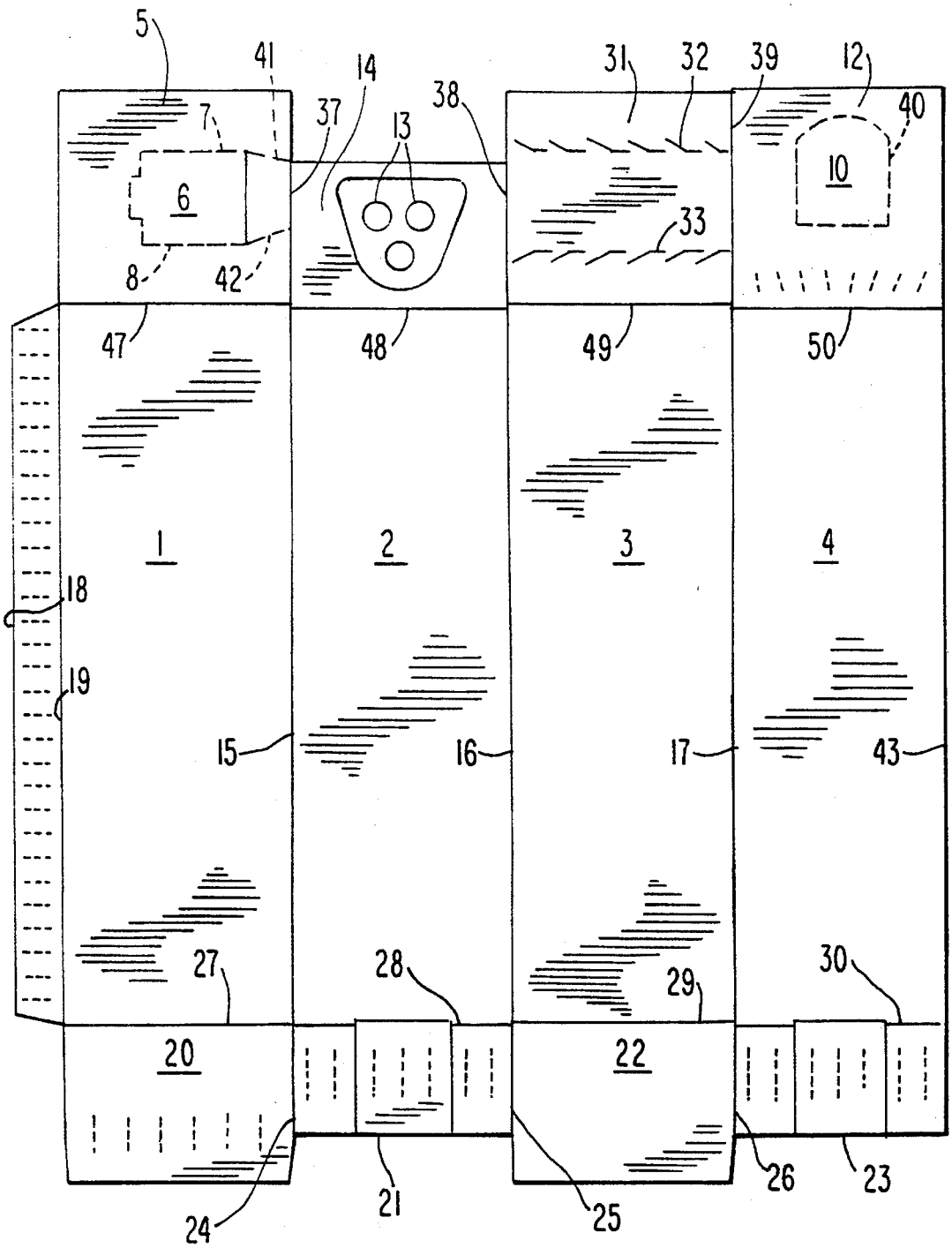
FIG. 3 shows a blank representing an embodiment of the invention as the blank is cut and creased preparatory to folding.

FIG. 3 represents a blank from which the resealable shaker carton can be prepared, and includes side walls 1, 2, 3, and 4 formed by score lines 15, 16 and 17, and tab 18 formed by score line 19. Bottom sections or flaps 20, 21, 22 and 23 are separated by die-cut lines 24, 25 and 26 and are formed by score lines 27, 28, 29 and 30.

The top sections of the container are separated from one another by die-cut lines 37, 38 and 39 and from their corresponding side sections by score lines 47, 48, 49 and 50. Innermost section 14 contains registered perforations or openings 13 which control the flow of the powdered material when it is being paused. Second from the innermost section is section 12 which contains die-cut piece 10 formed by perforated line 40 registered with perforations or openings 13 in innermost section 14. Intermediate or second from the outermost section is section 5 which contains hinged flap 6, registered with openings 13 and die-cut piece 10, and formed by perforated lines 7 and 8 containing tapered sections 41 and 42 designed to form a tapered end of the hinged flap to facilitate grasping. Finally, outermost section 31 contains die-cut perforated lines 32 and 33 to form a removable section between them which is registered with perforations or openings 13, die-cut piece 10, and hinged flap 6.

In forming containers of this invention, tab 18 is affixed or glued to the interior surface of section 4 so that line 19 and edge 43 abut. Then, the bottom flaps 20 to 23 may be folded in turn to form a bottom surface. These flaps may be held in position with glue or staples, or the like. It is within the scope of the invention that two of the bottom flaps, such as 21 and 23 may be truncated so that they "fit" together on the same plane.

The top sections should be folded so that section 14 is folded first, then section 12, followed by section 5 and section 31. Each of sections 12, 5 and 31 should be glued or affixed, on the lateral edges to the preceding surface. In particular, section 5 should be affixed to section 12 by glue outwardly adjacent to the die-cut lines; piece 10 should be affixed to the undersurface of hinged flap 6; and section 31 should be affixed to section 5 by glue applied only between each of perforated lines 32 and 33 to the nearest border of section 31, with no glue applied between the perforated lines.

To open the containers of this invention, the removable segment of outermost section 31 between perforated lines 32 and 33, or in any other removable configuration covering hinged flap 6, is pulled off the top of the container to expose such hinged flap. The end of hinged flap 6 is grasped and pulled up so that perforated lines 7 and 8 tear and piece 10 is removed from section 12 to form opening 11. After use, hinged flap 6 is pressed down to cause piece 10 to fit snugly into opening 11 in section 12.

The perforations or openings 13 can comprise circular holes or slits wide enough to permit the passage of the pulverized material within. Typically, perforations 13 could comprise three triangularly spaced circular holes, each of which has a diameter of for example, about from 0.05 to 0.3 inch.

Although preferred, it is not absolutely necessary to provide the sections of the top portion of the container as part of a cut out blank which may be folded and glued to form the container. Thus, particularly in the use of containers having a cross section different from a square or a rectangle, the separate sections making up the top portion may be separately affixed to the one or more sidewalls of the container after they are shaped into three dimensional form.

We claim:

1. A three dimensional resealable container for dispensing powder or particulate material comprising a top portion, a bottom portion and at least one side portion, the top portion being comprised of an inner section with a die-cut piece, an intermediate section contiguous to said inner section and provided with a hinged flap portion adapted to open and close the container with the die-cut piece secured to the hinged flap, and an outermost section with a pattern of perforations such that a segment of such section which covers the hinged flap can be manually removed.

2. The container of claim 1 having a square or rectangular cross-section and four side portions, said sections of the top portion being extensions of the side portions adapted to lap one another.

3. A container of claim 1 wherein the leading edge of said hinged flap extends to the edge of the top portion, and a segment of each side of the hinged flap extending from its free end is tapered for easy gripping in opening and resealing the container.

4. The container of claim 2 wherein said cross-section is square.

5. The container of claim 2 containing four sections of said top portion which are extensions of said side portions, the innermost section containing openings or perforations designed to control the flow of powdered or particulate material in the container when it is being poured, the second from innermost section containing said die-cut piece registered with said openings or perforations, the second from outermost section containing said hinged flap registered with said openings or perforations and to which said die-cut piece is secured, and said outermost section in which said removable segment is defined as that between two perforated lines parallel to two opposite sides of the container and extending to the right angle sides of the container.

6. The container of claim 5 wherein said cross-section is square.

* * * * *